US011761175B2

(12) United States Patent
Kondo et al.

(10) Patent No.: US 11,761,175 B2
(45) Date of Patent: Sep. 19, 2023

(54) HYDRAULIC SYSTEM OF CONSTRUCTION MACHINE

(71) Applicant: KAWASAKI JUKOGYO KABUSHIKI KAISHA, Kobe (JP)

(72) Inventors: Akihiro Kondo, Kobe (JP); Naoki Hata, Kobe (JP); Nobuyuki Kinoshita, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 3 days.

(21) Appl. No.: 17/637,719

(22) PCT Filed: Jul. 31, 2020

(86) PCT No.: PCT/JP2020/029482
§ 371 (c)(1),
(2) Date: Feb. 23, 2022

(87) PCT Pub. No.: WO2021/039286
PCT Pub. Date: Mar. 4, 2021

(65) Prior Publication Data

US 2022/0364329 A1 Nov. 17, 2022

(30) Foreign Application Priority Data

Aug. 23, 2019 (JP) ..... 2019-152661

(51) Int. Cl.
*E02F 9/22* (2006.01)
*F15B 11/08* (2006.01)
(Continued)

(52) U.S. Cl.
CPC ..... *E02F 9/2267* (2013.01); *E02F 9/128* (2013.01); *E02F 9/2285* (2013.01); *F15B 11/08* (2013.01);
(Continued)

(58) Field of Classification Search
CPC . E02F 9/128; F15B 13/0433; F15B 2211/715; F15B 2211/7058
See application file for complete search history.

(56) References Cited

U.S. PATENT DOCUMENTS 4,317,331 A * 3/1982 Aruga ..... B60W 10/18 60/436
5,709,083 A * 1/1998 Sorbel ..... E02F 9/123 60/436

(Continued)

FOREIGN PATENT DOCUMENTS

JP 2019-023409 A 2/2019

*Primary Examiner* — Thomas E Lazo
(74) *Attorney, Agent, or Firm* — Oliff PLC

(57) ABSTRACT

A hydraulic system includes: a slewing motor; a mechanical brake; and a slewing control valve interposed between a main pump and the slewing motor. A first pilot port of the slewing control valve is connected to a first solenoid proportional valve by a pilot line. A second pilot port of the slewing control valve is connected to a second solenoid proportional valve by a second pilot line. The first solenoid proportional valve and the second solenoid proportional valve are connected to an auxiliary pump by a primary pressure line. A switching valve is interposed between the auxiliary pump and the mechanical brake. The switching valve includes a pilot port that is connected to the first pilot line by a switching pilot line. The valve switches from a closed to an open position when a pilot pressure led to the pilot port becomes higher than or equal to a setting value.

5 Claims, 6 Drawing Sheets

(51) Int. Cl.

| | |
|---|---|
| ***F15B 11/16*** | (2006.01) |
| ***F15B 13/06*** | (2006.01) |
| ***E02F 9/12*** | (2006.01) |
| ***F15B 13/043*** | (2006.01) |

(52) U.S. Cl.
CPC ..... *F15B 11/16* (2013.01); *F15B 13/0433* (2013.01); *F15B 13/06* (2013.01); *F15B 2211/7058* (2013.01); *F15B 2211/715* (2013.01)

(56) References Cited

U.S. PATENT DOCUMENTS

| | | | | |
|---|---|---|---|---|
| 9,057,173 | B2 * | 6/2015 | Hiroki | B60L 50/61 |
| 9,366,271 | B2 * | 6/2016 | Tajima | E02F 9/128 |
| 2017/0166253 | A1 * | 6/2017 | Kondo | E02F 9/2267 |

* cited by examiner

HYDRAULIC SYSTEM OF CONSTRUCTION MACHINE

CROSS-REFERENCE TO RELATED APPLICATIONS

This application is national stage application of International Application No. PCT/JP2020/029482, filed on Jul. 31, 2020, which designates the United States, and claims the benefit of Japanese Patent Application No. 2019-152661, filed on Aug. 23, 2019, the entire contents of which are incorporated herein by reference.

TECHNICAL FIELD

The present invention relates to a hydraulic system of a construction machine.

BACKGROUND ART

In construction machines such as hydraulic excavators and hydraulic cranes, the components thereof are driven by a hydraulic system. The hydraulic system includes, for example, a slewing motor and a boom cylinder as hydraulic actuators. The slewing motor slews a slewing unit, and the boom cylinder luffs a boom provided on the slewing unit. These hydraulic actuators are supplied with hydraulic oil from a main pump via control valves.

Generally speaking, each control valve includes: a spool disposed in a housing; and a pair of pilot ports for moving the spool. In a case where an operation device that outputs an electrical signal is used as an operation device to move the control valve, solenoid proportional valves are connected to the respective pilot ports of the control valve, and the control valve is driven by the solenoid proportional valves.

The slewing motor may be provided with a mechanical brake (in the case of a self-propelled construction machine, the mechanical brake may be called a "parking brake") to prevent the slewing unit from slewing, for example, when the construction machine is parked on a slope (see Patent Literature 1, for example). When supplied with pressurized oil, the mechanical brake is switched from a brake-applied state, in which the mechanical brake prevents the rotation of the output shaft of the slewing motor, to a brake-released state, in which the mechanical brake allows the rotation of the output shaft. The mechanical brake is supplied with the pressurized oil from an auxiliary pump via a solenoid switching valve.

CITATION LIST

Patent Literature

PTL 1: Japanese Laid-Open Patent Application Publication No. 2019-23409

SUMMARY OF INVENTION

Technical Problem

However, the above-described configuration requires not only the solenoid valves for driving the control valve (i.e., the solenoid proportional valves), but also the solenoid valve dedicated for the mechanical brake (i.e., the solenoid switching valve).

In view of the above, an object of the present invention is to provide a hydraulic system of a construction machine, the hydraulic system making it possible to reduce the number of solenoid valves.

Solution to Problem

In order to solve the above-described problems, a hydraulic system of a construction machine according to the present invention includes: a slewing motor; a mechanical brake that is, when supplied with pressurized oil, switched from a brake-applied state, in which the mechanical brake prevents rotation of an output shaft of the slewing motor, to a brake-released state, in which the mechanical brake allows the rotation of the output shaft; a slewing control valve interposed between a main pump and the slewing motor, the slewing control valve including a first pilot port for a first slewing operation and a second pilot port for a second slewing operation; a first solenoid proportional valve connected to the first pilot port by a first pilot line; a second solenoid proportional valve connected to the second pilot port by a second pilot line; an auxiliary pump connected to the first solenoid proportional valve and the second solenoid proportional valve by a primary pressure line; and a switching valve interposed between the auxiliary pump and the mechanical brake, the switching valve including a pilot port that is connected to the first pilot line by a switching pilot line, the switching valve switching from a closed position to an open position when a pilot pressure led to the pilot port becomes higher than or equal to a setting value.

According to the above configuration, the pilot port of the switching valve for the mechanical brake is connected to the first pilot line between the first solenoid proportional valve and the slewing control valve. Therefore, when the first solenoid proportional valve outputs a secondary pressure higher than or equal to the setting value of the switching valve, the switching valve switches to an open state, and braking by the mechanical brake is released. That is, a pilot-type switching valve can be used as a switching valve for the mechanical brake, and the switching valve can be operated by utilizing the first solenoid proportional valve, which is intended for driving the slewing control valve. This makes it possible to reduce the number of solenoid valves.

Advantageous Effects of Invention

The present invention provides a hydraulic system of a construction machine, the hydraulic system making it possible to reduce the number of solenoid valves.

DESCRIPTION OF EMBODIMENTS

Embodiment 1

Figure 1:
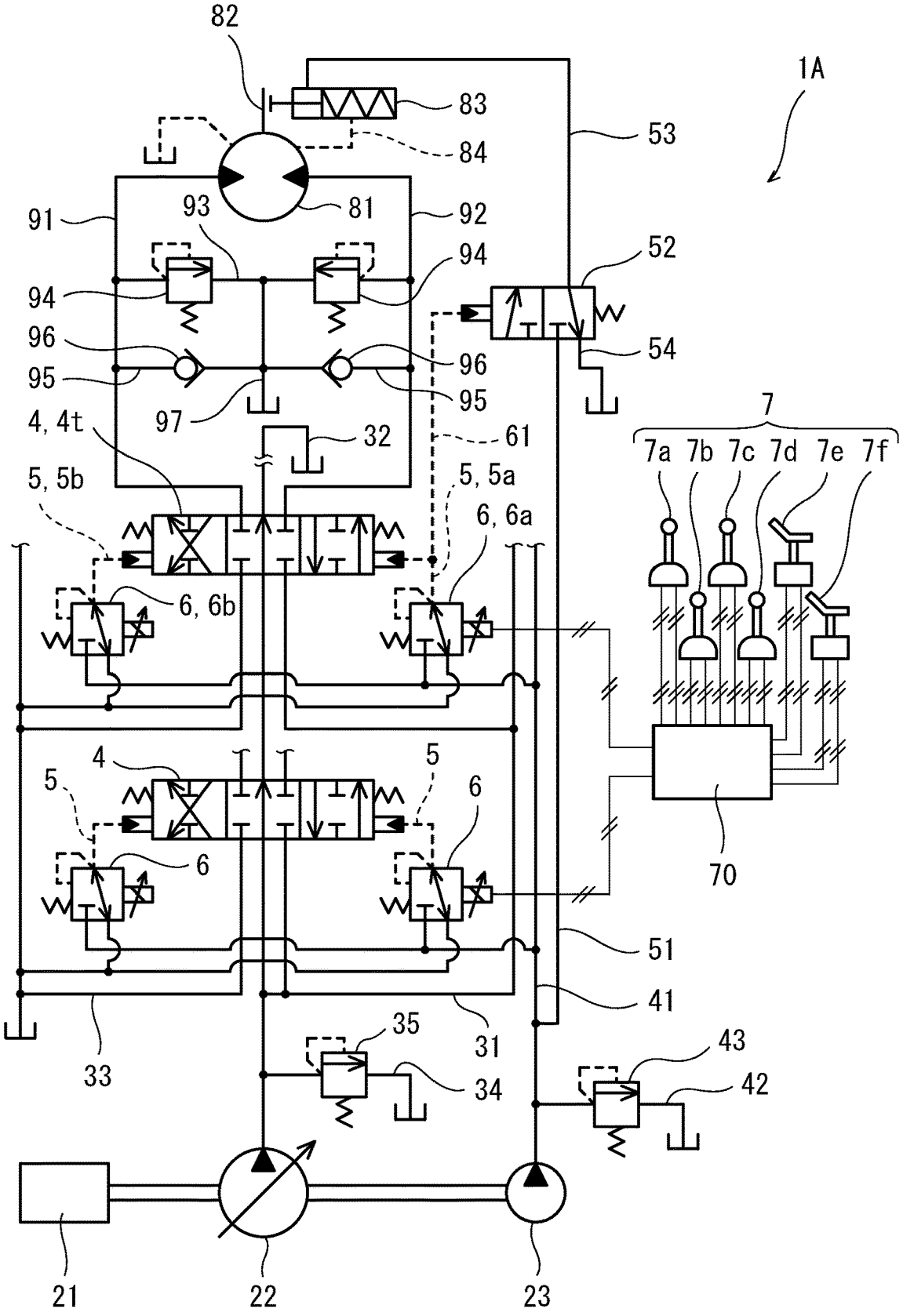
FIG. 1 shows a schematic configuration of a hydraulic system of a construction machine according to Embodiment 1 of the present invention.
Figure 2:
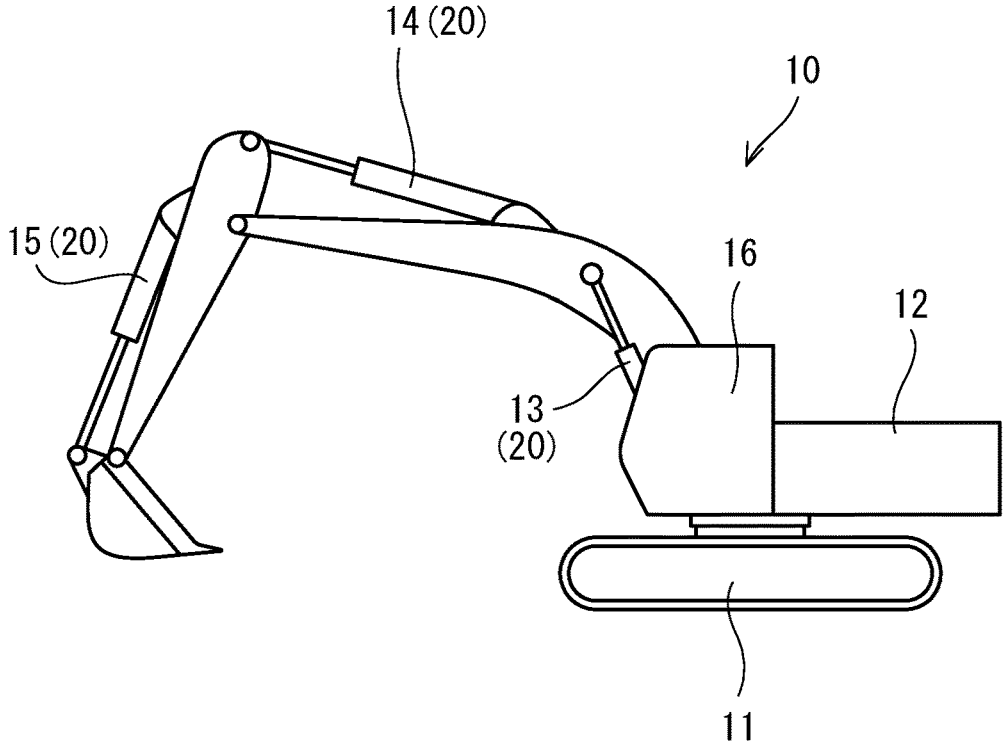
FIG. 2 is a side view of a hydraulic excavator, which is one example of the construction machine.

FIG. 1 shows a hydraulic system 1A of a construction machine according to Embodiment 1 of the present invention. FIG. 2 shows a construction machine 10, in which the hydraulic system 1A is installed. Although the construction machine 10 shown in FIG. 2 is a hydraulic excavator, the present invention is applicable to other construction machines, such as a hydraulic crane.

The construction machine 10 shown in FIG. 2 is a self-propelled construction machine, and includes a traveling unit 11. The construction machine 10 further includes: a slewing unit 12 slewably supported by the traveling unit 11; and a boom that is luffed relative to the slewing unit 12. An arm is swingably coupled to the distal end of the boom, and a bucket is swingably coupled to the distal end of the arm. The slewing unit 12 is equipped with a cabin 16 including an operator's seat. In the present embodiment, the traveling unit 11 includes crawlers as traveling means. Alternatively, the traveling means of the traveling unit 11 may be wheels. The construction machine 10 need not be of a self-propelled type.

The hydraulic system 1A includes, as hydraulic actuators 20, a boom cylinder 13, an arm cylinder 14, and a bucket cylinder 15, which are shown in FIG. 2, a slewing motor 81 shown in FIG. 1, and an unshown pair of travel motors (a left travel motor and a right travel motor). The boom cylinder 13 luffs the boom. The arm cylinder 14 swings the arm. The bucket cylinder 15 swings the bucket. The slewing motor 81 slews the slewing unit 12. The left travel motor rotates the left crawler of the traveling unit 11, and the right travel motor rotates the right crawler of the traveling unit 11.

As shown in FIG. 1, the hydraulic system 1A further includes a main pump 22, which supplies hydraulic oil to the aforementioned hydraulic actuators 20. In FIG. 1, the hydraulic actuators 20 other than the slewing motor 81 are not shown for the purpose of simplifying the drawing.

The main pump 22 is driven by an engine 21. Alternatively, the main pump 22 may be driven by an electric motor. The engine 21 also drives an auxiliary pump 23. The number of main pumps 22 may be more than one.

The main pump 22 is a variable displacement pump (a swash plate pump or a bent axis pump) whose tilting angle is changeable. The delivery flow rate of the main pump 22 may be controlled by electrical positive control, or may be controlled by hydraulic negative control. Alternatively, the delivery flow rate of the main pump 22 may be controlled by load-sensing control.

Control valves 4 are interposed between the main pump 22 and the hydraulic actuators 20. In the present embodiment, all the control valves 4 are three-position valves. Alternatively, one or more of the control valves 4 may be two-position valves.

All the control valves 4 are connected to the main pump 22 by a supply line 31, and connected to a tank by a tank line 33. Each control valve 4 is connected to a corresponding one of the hydraulic actuators 20 by a pair of supply/discharge lines. In a case where the number of main pumps 22 is more than one, the same number of groups of the control valves 4 as the number of main pumps 22 are formed. In each group, the control valves 4 are connected to the corresponding main pump 22 by the supply line 31.

For example, the control valves 4 include: a boom control valve that controls supply and discharge of the hydraulic oil to and from the boom cylinder 13; an arm control valve that controls supply and discharge of the hydraulic oil to and from the arm cylinder 14; and a bucket control valve that controls supply and discharge of the hydraulic oil to and from the bucket cylinder 15. The control valves 4 also include a slewing control valve 4*t*, which controls supply and discharge of the hydraulic oil to and from the slewing motor 81.

The aforementioned supply line 31 includes a main passage and branch passages. The main passage extends from the main pump 22. The branch passages are branched off from the main passage, and connect to the control valves 4. In the present embodiment, a center bypass line 32 is branched off from the main passage of the supply line 31, and the center bypass line 32 extends to the tank. The control valves 4 are disposed on the center bypass line 32. The center bypass line 32 may be eliminated.

A relief line 34 is branched off from the main passage of the supply line 31, and the relief line 34 is provided with a relief valve 35 for the main pump 22. The relief line 34 may be branched off from the center bypass line 32 at a position upstream of all the control valves 4.

Each control valve 4 includes: a spool disposed in a housing; and a pair of pilot ports for moving the spool. For example, the housings of all the control valves 4 may be integrated together to form a multi-control valve unit. The pilot ports of each control valve 4 are connected to respective solenoid proportional valves 6 by respective pilot lines 5.

Each solenoid proportional valve 6 is a direct proportional valve outputting a secondary pressure that indicates a positive correlation with a command current. Alternatively, each solenoid proportional valve 6 may be an inverse proportional valve outputting a secondary pressure that indicates a negative correlation with the command current.

All the solenoid proportional valves 6 are connected to the auxiliary pump 23 by a primary pressure line 41. The primary pressure line 41 includes a main passage and branch passages. The main passage extends from the auxiliary pump 23. The branch passages are branched off from the main passage, and connect to the solenoid proportional valves 6. A relief line 42 is branched off from the main passage of the primary pressure line 41, and the relief line 42 is provided with a relief valve 43 for the auxiliary pump 23.

Operation devices 7 to move the control valves 4 are disposed in the aforementioned cabin 16. Each operation device 7 includes an operating unit (an operating lever or a foot pedal) that receives an operation for moving a corresponding one of the hydraulic actuators 20, and outputs an electrical signal corresponding to an operating amount of the operating unit (e.g., an inclination angle of the operating lever).

Specifically, the operation devices 7 include: a boom operation device 7*a*, an arm operation device 7*b*, a bucket operation device 7*c*, and a slewing operation device 7*d*, each of which includes an operating lever; and a left travel operation device 7*e* and a right travel operation device 7*f*, each of which includes a foot pedal. Some of the operation devices 7 may be combined together and may share the same operating lever. For example, the boom operation device 7*a* and the bucket operation device 7*c* may be combined together, and the arm operation device 7*b* and the slewing operation device 7*d* may be combined together.

The operating lever of the boom operation device 7*a* receives a boom raising operation and a boom lowering operation. The operating lever of the arm operation device 7*b* receives an arm crowding operation and an arm pushing operation. The operating lever of the bucket operation device 7*c* receives a bucket excavating operation and a bucket dumping operation. The operating lever of the slewing operation device 7*d* receives a first slewing operation and a second slewing operation. Each of the foot pedal of the left travel operation device 7*e* and the foot pedal of the right travel operation device 7*f* receives a forward travel operation and a backward travel operation.

One of the first and second slewing operations is a left slewing operation, and the other is a right slewing operation. The left slewing operation may be either the first slewing operation or the second slewing operation. When the operating lever of the slewing operation device 7*d* receives the first slewing operation (i.e., when the operating lever is inclined in a first slewing direction), the slewing operation device 7*d* outputs a first slewing electrical signal whose magnitude corresponds to the operating amount of the operating lever (i.e., the inclination angle of the operating lever). When the operating lever of the slewing operation device 7*d* receives the second slewing operation (i.e., when the operating lever is inclined in a second slewing direction), the slewing operation device 7*d* outputs a second slewing electrical signal whose magnitude corresponds to the operating amount of the operating lever (i.e., the inclination angle of the operating lever).

The electrical signal outputted from each operation device 7 is inputted to a controller 70. The controller 70 controls solenoid proportional valves 6 based on the electrical signals outputted from the operation devices 7. FIG. 1 shows only part of signal lines for simplifying the drawing. For example, the controller 70 is a computer including memories such as a ROM and RAM, a storage such as a HDD, and a CPU. The CPU executes a program stored in the ROM or HDD.

Next, the slewing control valve 4*t* interposed between the main pump 22 and the slewing motor 81 is described in more detail.

The slewing control valve 4*t* includes a first pilot port for the first slewing operation and a second pilot port for the second slewing operation. The first pilot port is connected to a first solenoid proportional valve 6*a* (one of the aforementioned solenoid proportional valves 6) by a first pilot line 5*a* (one of the aforementioned pilot lines 5), and the second pilot port is connected to a second solenoid proportional valve 6*b* (one of the aforementioned solenoid proportional valves 6) by a second pilot line 5*b* (one of the aforementioned pilot lines 5).

When the first slewing electrical signal is outputted from the slewing operation device 7*d*, the controller 70 feeds a command current to the first solenoid proportional valve 6*a*, and increases the command current in accordance with increase in the first slewing electrical signal. Similarly, when the second slewing electrical signal is outputted from the slewing operation device 7*d*, the controller 70 feeds a command current to the second solenoid proportional valve 6*b*, and increases the command current in accordance with increase in the second slewing electrical signal.

The slewing control valve 4*t* is connected to the slewing motor 81 by a pair of supply/discharge lines 91 and 92. The supply/discharge lines 91 and 92 are connected to each other by a bridging passage 93. The bridging passage 93 is provided with a pair of relief valves 94, which are directed opposite to each other. A portion of the bridging passage 93 between the relief valves 94 is connected to the tank by a make-up line 97. Each of the supply/discharge lines 91 and 92 is connected to the make-up line 97 by a corresponding one of bypass lines 95. Alternatively, the pair of bypass lines 95 may be provided on the bridging passage 93 in a manner to bypass the pair of relief valves 94, respectively. The bypass lines 95 are provided with check valves 96, respectively.

The slewing motor 81 is provided with a mechanical brake 83 to prevent the slewing unit 12 from slewing when the construction machine is parked, for example, on a slope. The mechanical brake 83 has a structure in which a spring thereof blocks an output shaft 82 of the slewing motor 81 from rotating. To release the blocking by the spring, hydraulic pressure is used. Specifically, when supplied with pressurized oil, the mechanical brake 83 is switched from a brake-applied state, in which the mechanical brake 83 prevents the rotation of the output shaft 82 of the slewing motor 81, to a brake-released state, in which the mechanical brake 83 allows the rotation of the output shaft 82. A drain line 84 extends from the mechanical brake 83 to the tank through the slewing motor 81.

The mechanical brake 83 is connected to a switching valve 52 by a supply/discharge line 53. The switching valve 52 is connected to the auxiliary pump 23 by a pump line 51, and to the tank by a tank line 54. The upstream portion of the pump line 51 and the upstream portion of the primary pressure line 41 merge together to form a shared passage.

The switching valve 52 interposed between the auxiliary pump 23 and the mechanical brake 83 includes a pilot port, and when a pilot pressure led to the pilot port becomes higher than or equal to a setting value $\alpha$, the switching valve 52 switches from a closed position, which is a neutral position, to an open position. When the switching valve 52 is in the closed position, the switching valve 52 blocks the pump line 51, and brings the supply/discharge line 53 into communication with the tank line 54. When the switching valve 52 is in the open position, the switching valve 52 brings the pump line 51 into communication with the supply/discharge line 53. The pilot port of the switching valve 52 is connected to the first pilot line 5*a* by a switching pilot line 61.

Figure 3:
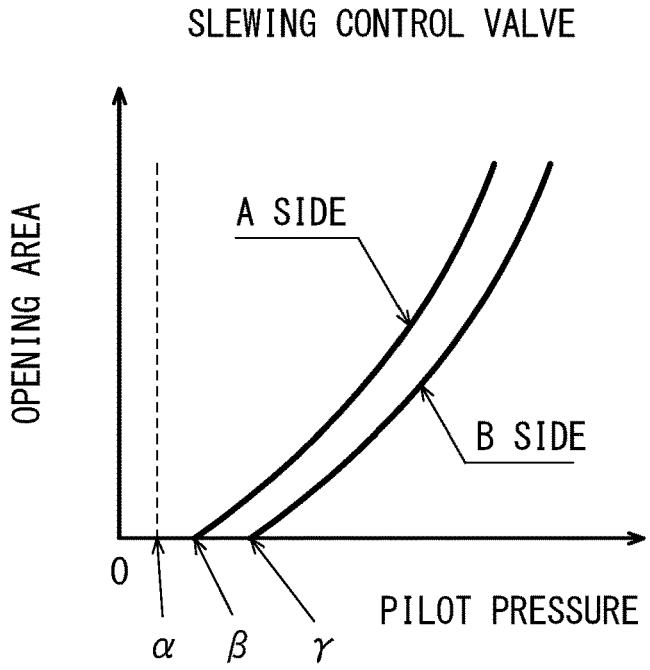
FIG. 3 is a graph showing a relationship between a pilot pressure to a slewing control valve and the opening area of the slewing control valve.
Figure 4:
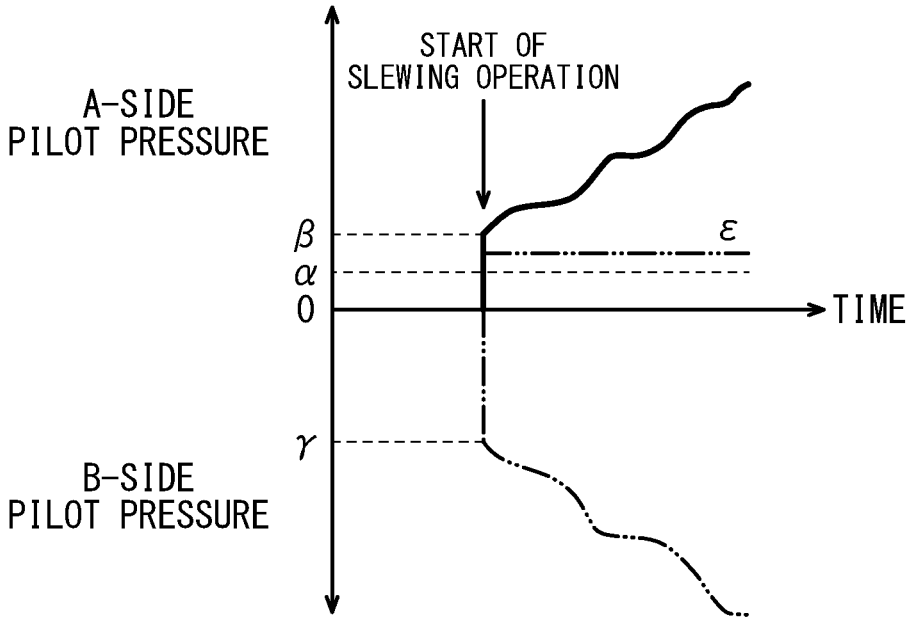
FIG. 4 is a graph showing temporal changes in pilot pressures outputted from first and second solenoid proportional valves when a slewing operation is performed alone.
Figure 5:
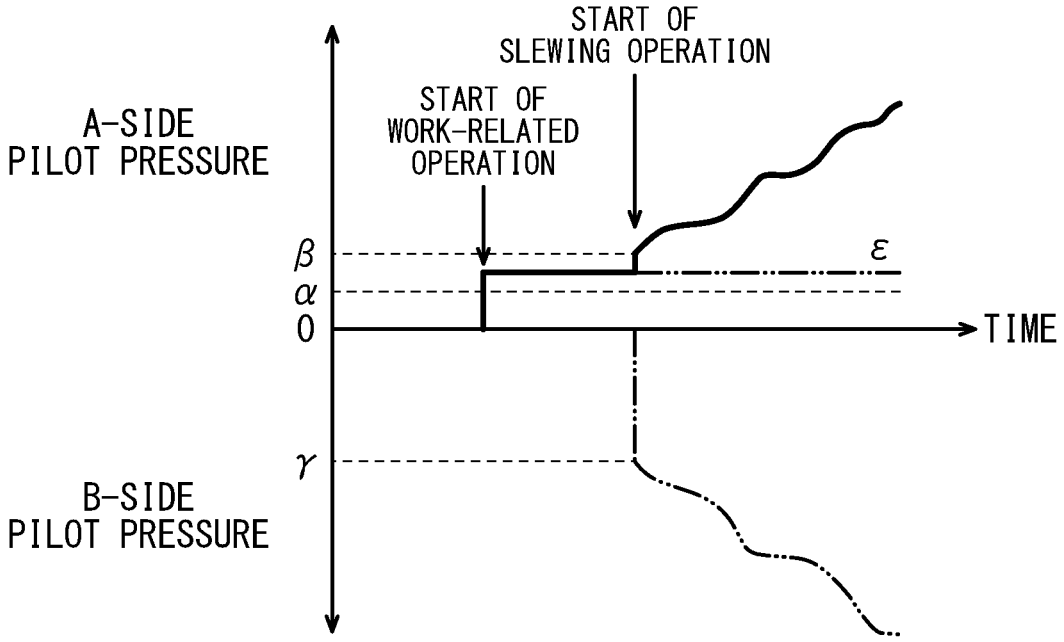
FIG. 5 is a graph showing temporal changes in pilot pressures outputted from the first and second solenoid proportional valves when a slewing operation is performed while a work-related operation is being performed.

Next, with reference to FIGS. 3 to 5, the control of the first solenoid proportional valve 6*a* and the second solenoid proportional valve 6*b* by the controller 70 is described in detail. In FIGS. 3 to 5, the first pilot port side of the slewing control valve 4*t* is referred to as "A side" and the second pilot port side of the slewing control valve 4*t* is referred to as "B side."

As shown in FIG. 3, in a case where the pilot pressure at one of the first and second pilot ports is zero, when the pilot pressure at the other one of the first and second pilot ports becomes a predetermined value β, the slewing control valve 4*t* starts opening (i.e., one of or both supply/discharge passages start communicating with a pump passage). The predetermined value β is greater than the setting value α of the switching valve 52.

When the first slewing operation is performed (i.e., while the first slewing electrical signal is being outputted from the slewing operation device 7*d*), the controller 70 feeds no command current to the second solenoid proportional valve 6*b*, but feeds a command current whose magnitude corresponds to the first slewing electrical signal to the first solenoid proportional valve 6*a* as previously described. However, as indicated by solid line in FIG. 4, the controller 70 controls the first solenoid proportional valve 6*a*, such that the first solenoid proportional valve 6*a* outputs a secondary pressure higher than or equal to the setting value α of the switching valve 52. To be more specific, at the start of the slewing operation, the controller 70 feeds a command current to the first solenoid proportional valve 6*a*, such that the secondary pressure from the first solenoid proportional valve 6*a* increases to the predetermined value β (i.e., the pilot pressure when the slewing control valve 4*t* starts opening). Consequently, the switching valve 52 switches to the open state, and the braking by the mechanical brake 83 is released.

On the other hand, when the second slewing operation is performed (i.e., while the second slewing electrical signal is being outputted from the slewing operation device 7*d*), the controller 70 feeds a command current to the first solenoid proportional valve 6*a*, such that the secondary pressure from the first solenoid proportional valve 6*a* becomes a predetermined value ε as indicated by two-dot chain line in FIG. 4, and feeds a command current whose magnitude corresponds to the second slewing electrical signal to the second solenoid proportional valve 6*b* as previously described. The predetermined value c is greater than or equal to the setting value α of the switching valve 52, and is less than the aforementioned predetermined value β.

Since the pressure at the first pilot port of the slewing control valve 4*t* is the predetermined value c, the slewing control valve 4*t* does not open until the pressure at the second pilot port becomes a predetermined value γ (=β+ε). Accordingly, at the start of the slewing operation, the controller 70 feeds a command current to the second solenoid proportional valve 6*b*, such that the secondary pressure from the second solenoid proportional valve 6*b* increases to the predetermined value γ. Consequently, the switching valve 52 switches to the open state, and the braking by the mechanical brake 83 is released.

As described above, both when the first slewing operation is performed and when the second slewing operation is performed, the controller 70 controls the first solenoid proportional valve 6*a*, such that the first solenoid proportional valve 6*a* outputs a secondary pressure higher than or equal to the setting value α of the switching valve 52.

Further, in the present embodiment, also when a boom operation, an arm operation, or a bucket operation (hereinafter, each of these operations is referred to as a "work-related operation") is performed, the controller 70 controls the first solenoid proportional valve 6*a*, such that the first solenoid proportional valve 6*a* outputs a secondary pressure higher than or equal to the setting value α of the switching valve 52. Whether or not a boom operation is being performed is determined based on whether or not the boom operation device 7*a* is outputting a boom electrical signal. Whether or not an arm operation is being performed is determined based on whether or not the arm operation device 7*b* is outputting an arm electrical signal. Whether or not a bucket operation is being performed is determined based on whether or not the bucket operation device 7*c* is outputting a bucket electrical signal.

To be more specific, as shown in FIG. 5, at the start of the work-related operation, the controller 70 feeds a command current to the first solenoid proportional valve 6*a*, such that the secondary pressure from the first solenoid proportional valve 6*a* increases to the predetermined value ε. Consequently, the switching valve 52 switches to the open state, and the braking by the mechanical brake 83 is released. The secondary pressure from the first solenoid proportional valve 6*a* is kept to the predetermined value c while the work-related operation is being performed, and becomes zero when the work-related operation is ended.

Therefore, when the first slewing operation is performed while the work-related operation is being performed, as indicated by solid line in FIG. 5, at the start of the slewing operation, the secondary pressure from the first solenoid proportional valve 6*a* increases from the predetermined value ε to the predetermined value β. On the other hand, when the second slewing operation is performed while the work-related operation is being performed, the second solenoid proportional valve 6*b* is controlled in the same manner as in the case shown in FIG. 4 where the second slewing operation is performed alone.

As described above, in the hydraulic system 1A of the present embodiment, the pilot port of the switching valve 52 for the mechanical brake 83 is connected to the first pilot line 5*a* between the first solenoid proportional valve 6*a* and the slewing control valve 4*t*. Therefore, when the first solenoid proportional valve 6*a* outputs a secondary pressure higher than or equal to the setting value α of the switching valve 52, the switching valve 52 switches to the open state, and the braking by the mechanical brake 83 is released. That is, the pilot-type switching valve 52 can be used as a switching valve for the mechanical brake 83, and the switching valve 52 can be operated by utilizing the first solenoid proportional valve 6*a*, which is intended for driving the slewing control valve 4*t*. This makes it possible to reduce the number of solenoid valves.

Embodiment 2

Figure 6:
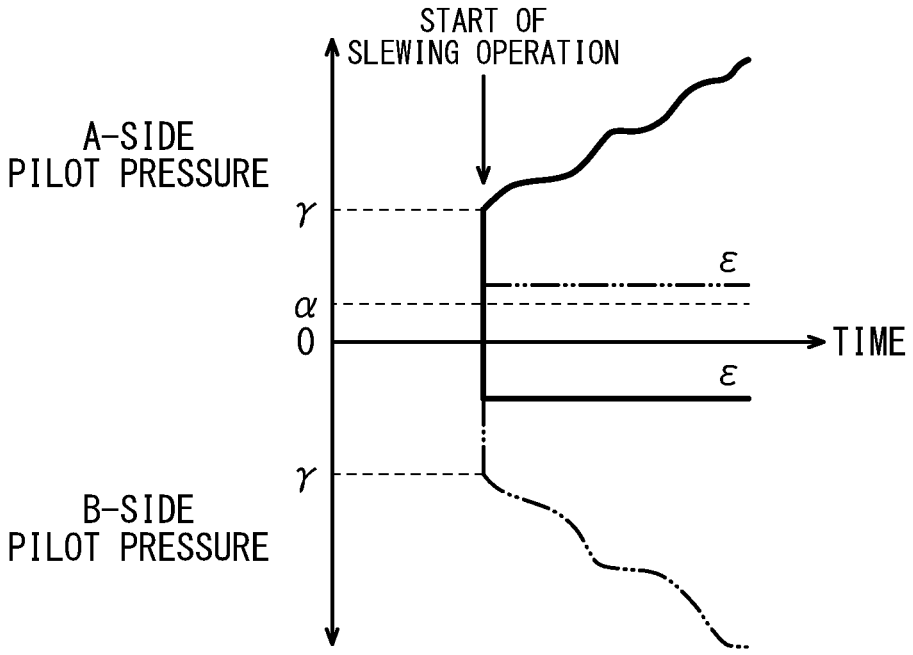
FIG. 6 is a graph showing temporal changes in secondary pressures outputted from the first and second solenoid proportional valves when a slewing operation is performed alone in Embodiment 2 of the present invention.
Figure 7:
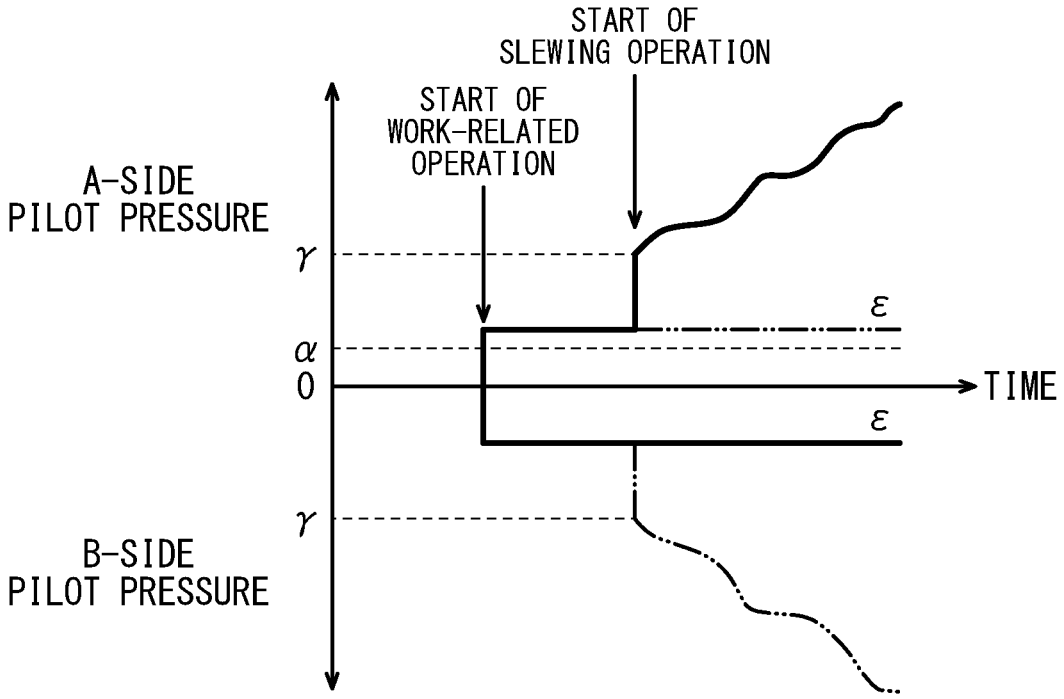
FIG. 7 is a graph showing temporal changes in secondary pressures outputted from the first and second solenoid proportional valves when a slewing operation is performed while a work-related operation is being performed in Embodiment 2.

Next, with reference to FIG. 6 and FIG. 7, a hydraulic system according to Embodiment 2 of the present invention is described. The hydraulic system of the present embodiment is different from the hydraulic system of Embodiment 1 only in terms of the control of the first solenoid proportional valve 6*a* and the second solenoid proportional valve 6*b*. That is, the configuration of the hydraulic system of the present embodiment is as shown in FIG. 1.

In the present embodiment, both when the first slewing operation is performed and when the second slewing operation is performed, the controller 70 controls the first solenoid proportional valve 6*a* and the second solenoid proportional valve 6*b*, such that each of the first solenoid proportional valve 6*a* and the second solenoid proportional valve 6*b* outputs a secondary pressure higher than or equal to the setting value α of the switching valve 52.

To be more specific, when the first slewing operation is performed (i.e., while the first slewing electrical signal is being outputted from the slewing operation device 7*d*), the controller 70 feeds a command current to the second solenoid proportional valve 6*b*, such that the secondary pressure from the second solenoid proportional valve 6*b* becomes the predetermined value ε as indicated by solid line in FIG. 6, and feeds a command current whose magnitude corresponds to the first slewing electrical signal to the first solenoid proportional valve 6*a* as previously described. As described in Embodiment 1, the predetermined value ε is greater than or equal to the setting value α of the switching valve 52. In the present embodiment, the predetermined value c need not be less than the aforementioned predetermined value β (the predetermined value β is, in a case where the pilot pressure at one of the first and second pilot ports is zero, the pilot pressure at the other one of the first and second pilot ports when the slewing control valve 4*t* starts opening). However, desirably, the predetermined value ε is less than the predetermined value β.

Since the pressure at the second pilot port of the slewing control valve 4*t* is the predetermined value c, the slewing control valve 4*t* does not open until the pressure at the first pilot port becomes the predetermined value γ (=β+ε). Accordingly, at the start of the slewing operation, the controller 70 feeds a command current to the first solenoid proportional valve 6*a*, such that the secondary pressure from the first solenoid proportional valve 6*a* increases to the predetermined value γ. Consequently, the switching valve 52 switches to the open state, and the braking by the mechanical brake 83 is released.

When the second slewing operation is performed (i.e., while the second slewing electrical signal is being outputted from the slewing operation device 7*d*), the control of the first solenoid proportional valve 6*a* and the second solenoid proportional valve 6*b* is performed in the same manner as the control described in Embodiment 1 as indicated by two-dot chain line in FIG. 6.

Further, in the present embodiment, when a boom operation, an arm operation, or a bucket operation is performed (i.e., when a work-related operation is performed), the controller 70 controls the first solenoid proportional valve 6*a* and the second solenoid proportional valve 6*b*, such that each of the first solenoid proportional valve 6*a* and the second solenoid proportional valve 6*b* outputs a secondary pressure higher than or equal to the setting value α of the switching valve 52.

To be more specific, as shown in FIG. 7, at the start of the work-related operation, the controller 70 feeds a command current to the first solenoid proportional valve 6*a*, such that the secondary pressure from the first solenoid proportional valve 6*a* increases to the predetermined value c, and feeds a command current to the second solenoid proportional valve 6*b*, such that the secondary pressure from the second solenoid proportional valve 6*b* increases to the predetermined value ε. Consequently, the switching valve 52 switches to the open state, and the braking by the mechanical brake 83 is released. Each of the secondary pressure from the first solenoid proportional valve 6*a* and the secondary pressure from the second solenoid proportional valve 6*b* is kept to the predetermined value c while the work-related operation is being performed, and becomes zero when the work-related operation is ended.

Therefore, when the first slewing operation is performed while the work-related operation is being performed, as indicated by solid line in FIG. 7, at the start of the slewing operation, the secondary pressure from the first solenoid proportional valve 6*a* increases from the predetermined value ε to the predetermined value γ. On the other hand, when the second slewing operation is performed while the work-related operation is being performed, as indicated by two-dot chain line in FIG. 7, at the start of the slewing operation, the secondary pressure from the second solenoid proportional valve 6*b* increases from the predetermined value ε to the predetermined value γ.

The secondary pressure from the second solenoid proportional valve 6*b* when the first slewing operation is performed may be zero as in Embodiment 1. In this case, however, the pressure difference between the pilot pressure for switching the switching valve 52 (i.e., the predetermined value ε in FIG. 4) and the pilot pressure when the slewing control valve starts opening (i.e., the predetermined value β in FIG. 4) is small. Therefore, it is desirable to take malfunction preventative measures, such as strengthening a return spring in the slewing control valve 4*t*. In this respect, when the first slewing operation is performed, if the second solenoid proportional valve 6*b* outputs a secondary pressure higher than or equal to the setting value α of the switching valve 52 as in the present embodiment, the pressure difference between the pilot pressure for switching the switching valve 52 (i.e., the predetermined value ε in FIG. 6) and the pilot pressure when the slewing control valve 4*t* starts opening (i.e., the predetermined value γ in FIG. 6) becomes great. Therefore, taking malfunction preventative measures is unnecessary.

Other Embodiments

The present invention is not limited to the above-described embodiments. Various modifications can be made without departing from the scope of the present invention.

For example, when a work-related operation is performed, the controller 70 need not feed a command current to the first solenoid proportional valve 6*a*. However, when the work-related operation is performed, if the secondary pressure from the first solenoid proportional valve 6*a* is higher than or equal to the setting value α of the switching valve 52 as in Embodiment 1 and Embodiment 2, the mechanical brake 83 is switched to the brake-released state not only when a slewing operation is performed, but also when a boom operation is performed, when an arm operation is performed, and when a bucket operation is performed. For this reason, during a boom operation, an arm operation, or a bucket operation being performed, when force that causes the slewing unit 12 to slew is exerted, for example, from the ground, the mechanical brake 83 does not receive the force. Consequently, a situation where excessive force is applied to the mechanical brake 83 and thereby the mechanical brake 83 gets damaged is prevented. That is, the torque capacity of the mechanical brake 83 can be set to a torque capacity dedicated for stationary braking. Therefore, the mechanical brake 83 can be made compact.

Figure 8:
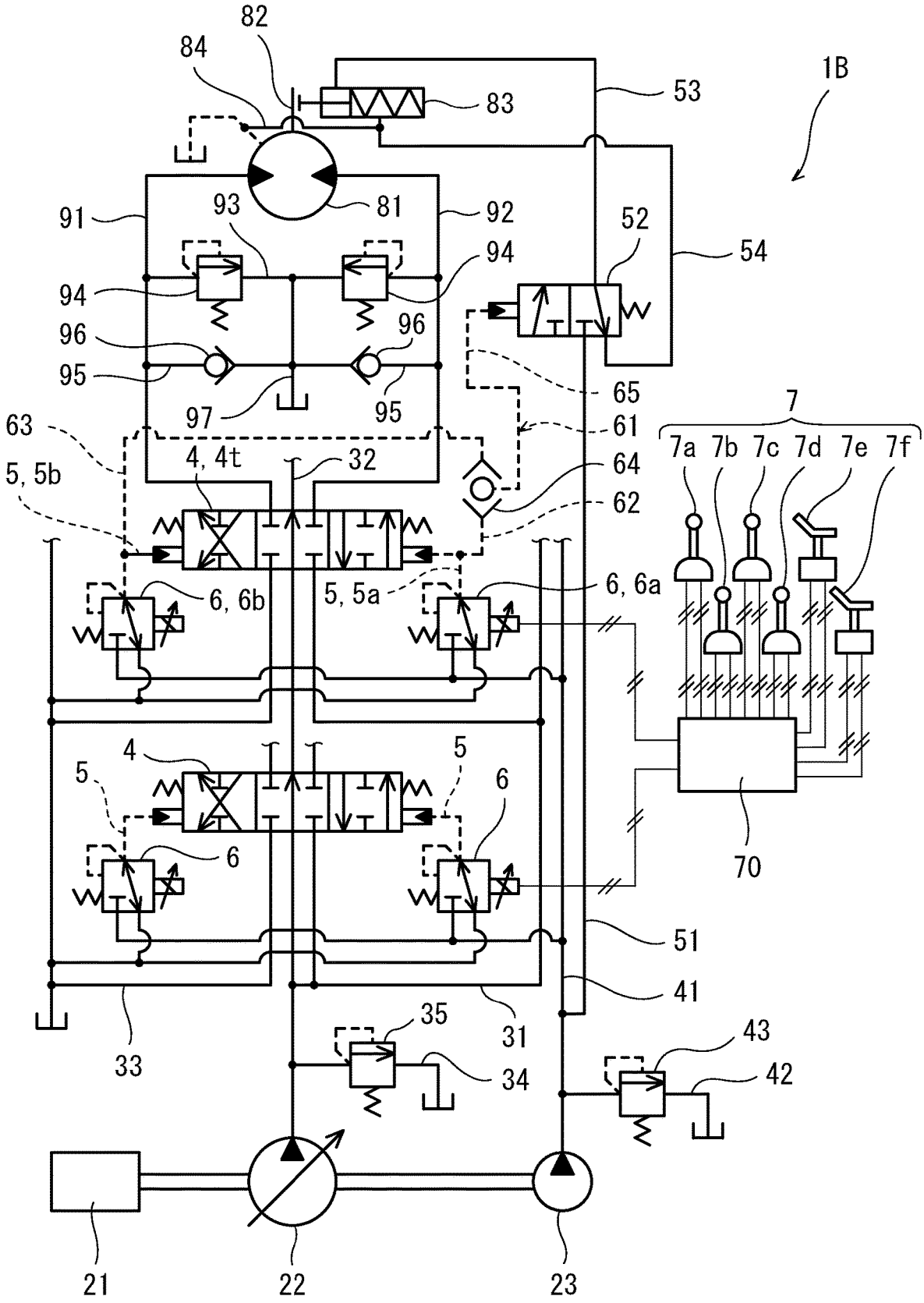
FIG. 8 shows a schematic configuration of a hydraulic system of a construction machine according to another embodiment.

Alternatively, as in a hydraulic system 1B shown in FIG. 8, the pilot port of the switching valve 52 may be connected, by the switching pilot line 61, not only to the first pilot line 5*a*, but also to the second pilot line 5*b*. In the example shown in FIG. 8, the switching pilot line 61 includes: a high pressure selective valve 64; a pair of input lines 62 and 63, which connects a pair of input ports of the high pressure selective valve 64 to the first pilot line 5*a* and the second pilot line 5*b*, respectively; and an output line 65, which connects an output port of the high pressure selective valve 64 to the pilot port of the switching valve 52. In other words, the switching pilot line 61 leads a higher one of the secondary pressure from the first solenoid proportional valve 6*a* or the secondary pressure from the second solenoid proportional valve 6*b* to the pilot port of the switching valve 52. According to this configuration, even if the first solenoid proportional valve 6*a* fails, the mechanical brake 83 can be switched to the brake-released state by utilizing the second solenoid proportional valve 6*b*.

As shown in FIG. 8, the switching valve 52 may be connected to the drain line 84 of the mechanical brake 83 by the tank line 54.

Further, in the configuration shown in FIG. 8, similar to Embodiment 1 and Embodiment 2, both when the first slewing operation is performed and when the second slewing operation is performed, the first solenoid proportional valve 6*a* may output a secondary pressure higher than or equal to the setting value $\alpha$ of the switching valve 52. However, by performing the control described below, the control of the first solenoid proportional valve 6*a* and the second solenoid proportional valve 6*b* after the braking by the mechanical brake 83 is released can be simplified.

Figure 9:
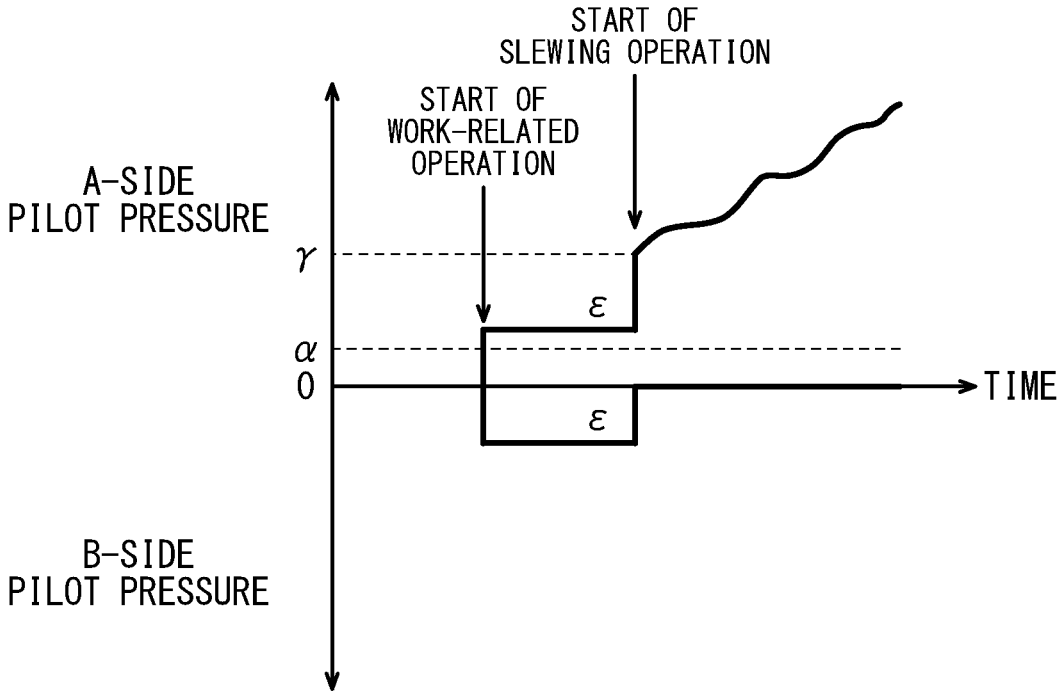
FIG. 9 is a graph showing one example of temporal changes in secondary pressures outputted from the first and second solenoid proportional valves when a first slewing operation is performed while a work-related operation is being performed in the other embodiment.

For example, as shown in FIG. 9, in a case where the first slewing operation is performed, after the start of the slewing operation, the secondary pressure from the second solenoid proportional valve 6*b* may be brought to zero, whereas in a case where the second slewing operation is performed, conversely to FIG. 9, after the start of the slewing operation, the secondary pressure from the first solenoid proportional valve 6*a* may be brought to zero. In this manner, after the start of the slewing operation, normal control of controlling only one of the first and second solenoid proportional valves 6*a* and 6*b* that corresponds to the slewing operation being performed may be performed.

SUMMARY

As described above, the hydraulic system of the construction machine according to the present invention includes: a slewing motor; a mechanical brake that is, when supplied with pressurized oil, switched from a brake-applied state, in which the mechanical brake prevents rotation of an output shaft of the slewing motor, to a brake-released state, in which the mechanical brake allows the rotation of the output shaft; a slewing control valve interposed between a main pump and the slewing motor, the slewing control valve including a first pilot port for a first slewing operation and a second pilot port for a second slewing operation; a first solenoid proportional valve connected to the first pilot port by a first pilot line; a second solenoid proportional valve connected to the second pilot port by a second pilot line; an auxiliary pump connected to the first solenoid proportional valve and the second solenoid proportional valve by a primary pressure line; and a switching valve interposed between the auxiliary pump and the mechanical brake, the switching valve including a pilot port that is connected to the first pilot line by a switching pilot line, the switching valve switching from a closed position to an open position when a pilot pressure led to the pilot port becomes higher than or equal to a setting value.

According to the above configuration, the pilot port of the switching valve for the mechanical brake is connected to the first pilot line between the first solenoid proportional valve and the slewing control valve. Therefore, when the first solenoid proportional valve outputs a secondary pressure higher than or equal to the setting value of the switching valve, the switching valve switches to an open state, and braking by the mechanical brake is released. That is, a pilot-type switching valve can be used as a switching valve for the mechanical brake, and the switching valve can be operated by utilizing the first solenoid proportional valve, which is intended for driving the slewing control valve. This makes it possible to reduce the number of solenoid valves.

For example, the above hydraulic system may further include: a slewing operation device that outputs a first slewing electrical signal when receiving the first slewing operation, the first slewing electrical signal corresponding to an operating amount of the first slewing operation, and outputs a second slewing electrical signal when receiving the second slewing operation, the second slewing electrical signal corresponding to an operating amount of the second slewing operation; and a controller that controls the first solenoid proportional valve and the second solenoid proportional valve based on the first slewing electrical signal and the second slewing electrical signal. Both when the first slewing operation is performed and when the second slewing operation is performed, the controller may control the first solenoid proportional valve, such that the first solenoid proportional valve outputs a secondary pressure higher than or equal to the setting value.

Both when the first slewing operation is performed and when the second slewing operation is performed, the controller may control the first solenoid proportional valve and the second solenoid proportional valve, such that each of the first solenoid proportional valve and the second solenoid proportional valve outputs a secondary pressure higher than or equal to the setting value. The secondary pressure from the second solenoid proportional valve when the first slewing operation is performed may be zero. In this case, however, the pressure difference between the pilot pressure for switching the switching valve and the pilot pressure when the slewing control valve starts opening is small. Therefore, it is desirable to take malfunction preventative measures, such as strengthening a return spring in the slewing control valve. In this respect, when the first slewing operation is performed, if the second solenoid proportional valve outputs a secondary pressure higher than or equal to the setting value of the switching valve, the pressure difference between the pilot pressure for switching the switching valve and the pilot pressure when the slewing control valve starts opening becomes great. Therefore, taking malfunction preventative measures is unnecessary.

In a case where the first solenoid proportional valve outputs a secondary pressure higher than or equal to the setting value both when the first slewing operation is performed and when the second slewing operation is performed, the construction machine may be a self-propelled hydraulic excavator, and when a boom operation, an arm operation, or a bucket operation is performed, the controller may control the first solenoid proportional valve, such that the first solenoid proportional valve outputs a secondary pressure higher than or equal to the setting value.

Alternatively, in a case where each of the first solenoid proportional valve and the second solenoid proportional valve outputs a secondary pressure higher than or equal to the setting value both when the first slewing operation is performed and when the second slewing operation is performed, the construction machine may be a self-propelled hydraulic excavator, and when a boom operation, an arm operation, or a bucket operation is performed, the controller may control the first solenoid proportional valve and the second solenoid proportional valve, such that each of the first solenoid proportional valve and the second solenoid proportional valve outputs a secondary pressure higher than or equal to the setting value.

According to the above configurations, the mechanical brake is switched to the brake-released state not only when a slewing operation is performed, but also when a boom operation is performed, when an arm operation is performed, and when a bucket operation is performed. For this reason, during a boom operation, an arm operation, or a bucket operation being performed, when force that causes the slewing unit to slew is exerted, for example, from the ground, the mechanical brake does not receive the force. Consequently, a situation where excessive force is applied to the mechanical brake and thereby the mechanical brake gets damaged is prevented. That is, the torque capacity of the mechanical brake can be set to a torque capacity dedicated for stationary braking. Therefore, the mechanical brake can be made compact.

The pilot port of the switching valve may be connected to the first pilot line and the second pilot line by the switching pilot line. The switching pilot line may lead a higher one of a secondary pressure from the first solenoid proportional valve or a secondary pressure from the second solenoid proportional valve to the pilot port of the switching valve. According to this configuration, even if the first solenoid proportional valve fails, the mechanical brake can be switched to the brake-released state by utilizing the second solenoid proportional valve.

The invention claimed is:

1. A hydraulic system of a construction machine, comprising:

a slewing motor;

a mechanical brake that is, when supplied with pressurized oil, switched from a brake-applied state, in which the mechanical brake prevents rotation of an output shaft of the slewing motor, to a brake-released state, in which the mechanical brake allows the rotation of the output shaft;

a slewing control valve interposed between a main pump and the slewing motor, the slewing control valve including a first pilot port for a first slewing operation and a second pilot port for a second slewing operation;

a first solenoid proportional valve connected to the first pilot port by a first pilot line;

a second solenoid proportional valve connected to the second pilot port by a second pilot line;

an auxiliary pump connected to the first solenoid proportional valve and the second solenoid proportional valve by a primary pressure line;

a switching valve interposed between the auxiliary pump and the mechanical brake, the switching valve including a pilot port that is connected to the first pilot line by a switching pilot line, the switching valve switching from a closed position to an open position when a pilot pressure led to the pilot port becomes higher than or equal to a setting value;

a slewing operation device that includes a lever and outputs a first slewing electrical signal when receiving the first slewing operation, the first slewing electrical signal corresponding to an operating amount of the first slewing operation, and outputs a second slewing electrical signal when receiving the second slewing operation, the second slewing electrical signal corresponding to an operating amount of the second slewing operation; and a controller that controls the first solenoid proportional valve and the second solenoid proportional valve based on the first slewing electrical signal and the second slewing electrical signal, wherein both when the first slewing operation is performed and when the second slewing operation is performed, the controller controls the first solenoid proportional valve, such that the first solenoid proportional valve outputs a secondary pressure higher than or equal to the setting value.

2. The hydraulic system of a construction machine according to claim 1, wherein both when the first slewing operation is performed and when the second slewing operation is performed, the controller controls the first solenoid proportional valve and the second solenoid proportional valve, such that each of the first solenoid proportional valve and the second solenoid proportional valve outputs a secondary pressure higher than or equal to the setting value.

3. The hydraulic system of a construction machine according to claim 2, wherein the construction machine is a self-propelled hydraulic excavator, when a boom operation, an arm operation, or a bucket operation is performed, the controller controls the first solenoid proportional valve and the second solenoid proportional valve, such that each of the first solenoid proportional valve and the second solenoid proportional valve outputs a secondary pressure higher than or equal to the setting value.

4. The hydraulic system of a construction machine according to claim 1, wherein the construction machine is a self-propelled hydraulic excavator, when a boom operation, an arm operation, or a bucket operation is performed, the controller controls the first solenoid proportional valve, such that the first solenoid proportional valve outputs a secondary pressure higher than or equal to the setting value.

5. The hydraulic system of a construction machine according to claim 1, wherein the pilot port of the switching valve is connected to the first pilot line and the second pilot line by the switching pilot line, and the switching pilot line leads a higher one of a secondary pressure from the first solenoid proportional valve or a secondary pressure from the second solenoid proportional valve to the pilot port of the switching valve.

* * * * *